US006108946A

United States Patent [19]

Christy

[11] Patent Number: 6,108,946

[45] Date of Patent: Aug. 29, 2000

[54] PLOWED MATERIAL CATCHER FOR V-BLADE SNOWPLOW

[75] Inventor: Jody Christy, Iron Mountain, Mich.

[73] Assignee: M.J. Electric, Inc., Iron Mountain, Mich.

[21] Appl. No.: 09/320,671

[22] Filed: May 27, 1999

Related U.S. Application Data

[60] Provisional application No. 60/087,070, May 28, 1998.

[51] Int. Cl.[7] ..... E01H 5/06

[52] U.S. Cl. ..... 37/272; 37/273

[58] Field of Search ..... 37/217, 266, 269, 37/272, 273, 279, 283

[56] References Cited

U.S. PATENT DOCUMENTS

| | | | |
|---|---|---|---|
| 482,720 | 9/1892 | Black | 37/273 |
| 533,036 | 1/1895 | Cox | 37/217 |
| 1,284,562 | 11/1918 | Beck | 37/217 |
| 2,891,334 | 6/1959 | Kinzer | 37/217 |
| 3,526,979 | 9/1970 | Ladewski | 37/272 |
| 4,597,202 | 7/1986 | Weeks | 37/232 |

*Primary Examiner*—Robert E. Pezzuto
*Attorney, Agent, or Firm*—Jim Zegeer

[57] ABSTRACT

A V-blade plow having a pair of adjustable plow blades. Each plow blade has an inner end pivoted on a central pivot assembly. A plowed material catcher member is mounted below the central pivot assembly to prevent a trail of snow from passing through any space between the inner ends of the blades at any position of blade adjustment. The plowed material catcher member includes an arcuate ramp portion which projects forwardly of the central pivot assembly and directs snow to the blades respectively. The catcher member is made from a material selected from rubber, plastic or metal.

2 Claims, 3 Drawing Sheets

PLOWED MATERIAL CATCHER FOR V-BLADE SNOWPLOW

REFERENCE TO RELATED APPLICATION

This invention is the subject of provisional application Ser. No. 60/087,070 filed May 28, 1998 and entitled SNOW CATCHER.

BACKGROUND AND BRIEF DESCRIPTION OF THE INVENTION

The present invention provides a plowed material catcher attachment system for an adjustable V-bladed snowplow or other V-bladed plow.

The prior art uses flat rubber belting bolted to the cutting edges of the blades to prevent a small track of plowed material from passing the blades.

The object of the invention is to provide an adjustable V-bladed plow with a device to prevent the small trail of material which passes through the small opening between two blades in any blade position.

A plowed material (e.g. snow) catcher member is fixedly mounted below the center or vertical pivot assembly for the adjustable blades. It includes an arcuate ramp portion projecting forwardly of the central pivot assembly and directs plowed material to the blades, respectively.

Reference is made to Capra et al, U.S. Pat. No. 5,568,694 (incorporated herein by reference) for a full exposition of the plow and its functioning operation.

DESCRIPTION OF THE DRAWINGS

The above and other objects, advantage and features of the invention will become more clear when considered with the following specification and accompanying drawings wherein.

DETAILED DESCRIPTION OF THE INVENTION

Figure 1:
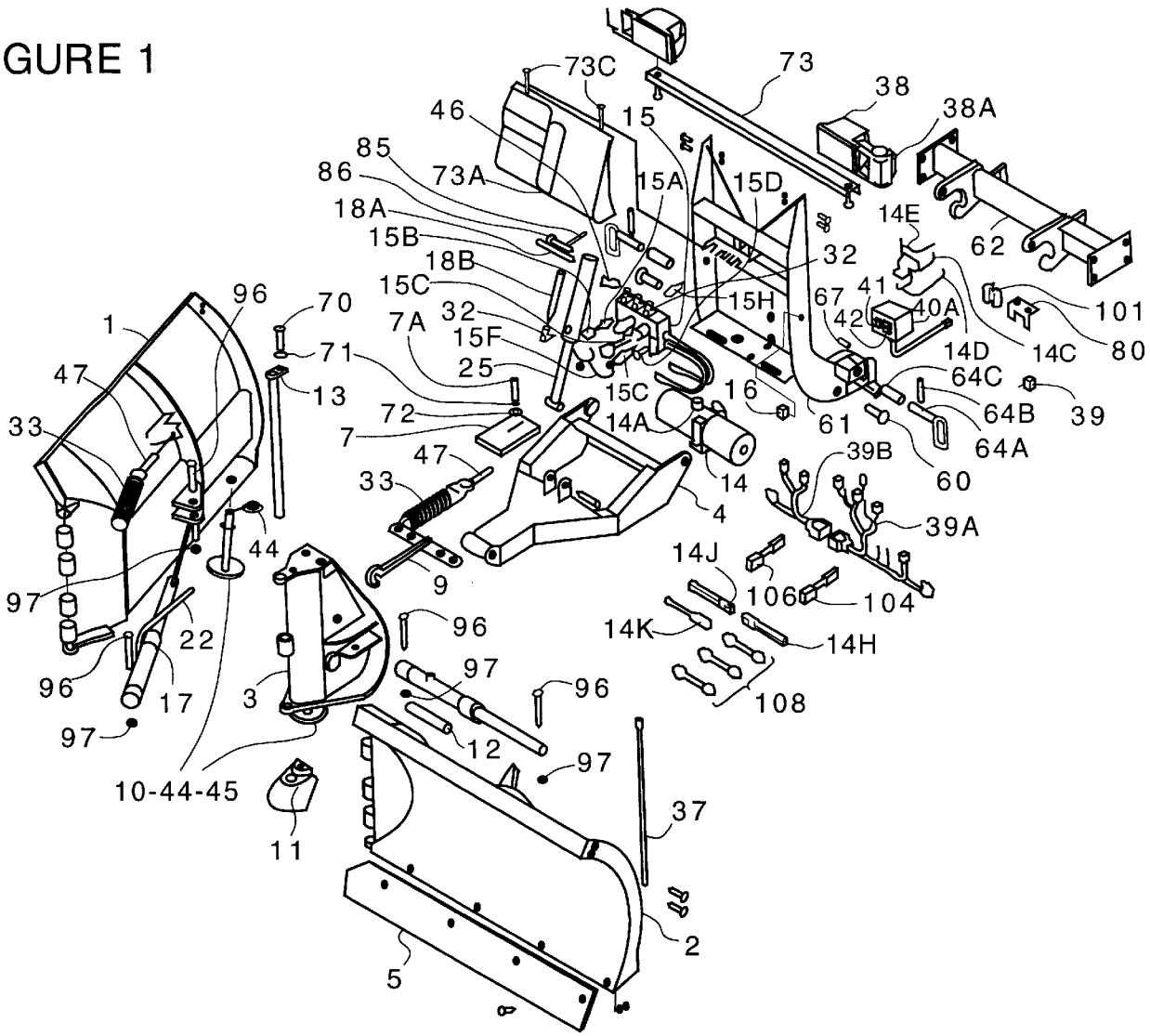
FIG. 1 is an exploded view of a snow plow system incorporating the invention.

Referring to FIG. 1, the following list sets out the component part number and description of the component part:

| Component Part | Description |
|---|---|
| 1 | Blade Half Right |
| 2 | Blade Half Left |
| 3 | Center Section, RT3 V-Blade (all models) |
| 4 | T-Frame, RT3 V-Blade (all models) |
| 5 | Cutting Edge, 7'6" V-Blade ⅝" Holes |
| 5 | Cutting Edge, 8'2" V-Blade ⅝" Holes |
| 5 | Cutting Edge, 9'2" V-Blade ⅝" Holes |
| 6 | Carriage Bolt Set |
| | Includes: |
| | (10) Carriage Bolts ⅝"–11 × 2" Grade #5 ZN |
| | (10) ⅝" Hardened Washers |
| | (10) ⅝" Lock Nuts |
| 7 | Bumper Stop, w/Mounting Hardware |
| 7 | A Self-Tapping Bolt, ⅜"–16 × 2" Hex Washer Head ZN |
| 9 | Spring Yoke, RT3 V-Blade |
| 10-44-45 | Plow Shoe Assembly |

-continued

| Component Part | Description |
|---|---|
| | Includes: |
| | (1) Plow Shoe (1" Shaft) |
| | (1) 7/16" Quick Pin |
| | (20) 1" Flat Washers |
| 10-44-45 | Plow Shoe, Cast Iron (Center Shoe) |
| | Includes: |
| | (1) Plow Shoe (1" Shaft), Cast Iron |
| | (1) 7/16" Quick Pin |
| | (20) 1" Flat Washers |
| 11 | Snow Catcher w/Mounting Hardware |
| 12 | Horizontal Hinge Pin Kit, RT3 V-Blade (all models) |
| 13 | Center Hinge Pin, RT3 V-Blade (all models) |
| 14 | Hydraulic Pump - Power Unit Barnes |
| 14 A | Hydraulic Pump Filter Cap |
| 14 B | Hydraulic Pump Motor-Barnes |
| 14 C | Hydraulic Pump Solenoid |
| 14 D | Hydraulic Pump Solenoid Ground Cable |
| 14 E | Battery cable, 66" |
| 14 H | Ground/Power Cable 60" (Vehicle Side) |
| 14 J | Ground/Power Cable 36" (Plow Side) |
| 14 K | Ground/Power Cable Dust Cap/Plug |
| 14 L | Hydraulic Reservoir Drain plug |
| 15 | Hydraulic Valve Assembly with SmartHitch |
| 15 A | Hydraulic Lift/Angle Valve |
| 15 B | Hydraulic Valve Coil |
| 15 C | Hydraulic Relief Valve |
| 15 D | Hydraulic Check Valve |
| 15 E | Hydraulic Valve Screen Cartridge |
| 15 F | Hydraulic Valve Ground Strap |
| 15 G | Hydraulic Valve, SmartHitch Attach |
| 15 H | Hydraulic Valve, Flow Control Cartridge |
| 16 | SmartHitch Toggle Switch Kit (Includes Switch and Jumpers) |
| 17 | Hydraulic Cylinder, Angle |
| 18 A | Hydraulic Hose ¼" × 12", ¼" MNPT × ¼" MNPT) |
| 18 B | Hydraulic Hose ¼" × 15 1/2", (¼" MNPT × ¼" MNPT) |
| 18 C | Hydraulic Hose ¼" × 15" (¼" ORB × " MNPT) |
| 22 | Hydraulic Hose ⅜" × 40" (¼" MNPT × ⅜" MNPT) |
| 25 | Hydraulic Cylinder, RT3 Lift |
| 32 | Hydraulic Swivel Fitting, 90 Deg. (¼" ORS × ¼" FPS) |
| 33 | Trip/Return Spring |
| 37 | Blade Guide Set |
| 37 A | Blade Guide Tip |
| 38 | Auxiliary Headlight Set, Low Profile Plastic |
| 38 A | Turn Signal Cover, Low Profile Plastic |
| 38 L | Auxiliary Headlight, Left, Low Profile Plastic |
| 38 R | Auxiliary Headlight, Right, Low Profile Plastic |
| 39 | Auxiliary Light Harness Assembly |
| | Includes: Toggle Switch Connectors |
| 39 A | Light and Control Harness 116" (Vehicle Side) |
| 39 B | Light and Control Harness 48" (Plow Side) |
| 40 A | Switch Box Control, V-Blade |
| 40 B | Joystick Control, V-Blade |
| 41 | Rocker Switch - Lift |
| 42 | Rocker Switch - Angle |
| 44 | Quick Pin - 7/16" |
| 46 | Hydraulic Fitting, 90 Deg. (⅛" MNPT × ¼" FNPT) |
| 47 | Eye Bolt, ½" |
| 55 | Hex Head Cap Screw, ⅝"–11 × 4½" GRS ZN |
| 60 | Pivot Pin, Kit (Includes Cotter Pins and Washers) |
| 60 A | Pivot Pin |
| 60 B | 3/16" Cotter Pin |
| 61 | Coupler Assembly |
| 62 | Push Beam Assembly, RT 3 |
| 62 A | Push Beam Support Plat RH (Passenger Side) |
| 62 B | Push Beam Support Plate LH (Driver Side) |
| 64 | Coupler Spring Pin Kit |
| | Includes: |
| | Coupler Spring Pin |
| | Rolled Pin |
| | Coupler Spring Pin Spring |

-continued

| Component Part | Description |
|---|---|
| 64 A | Coupler Spring Pin |
| 64 B | Rolled Pin (5/16" × 20½") |
| 64 C | Coupler Spring Pin Spring |
| 67 | Spring, SmartHitch Torsion Spring |
| 71 | Washer, ⅜" Split Lock |
| 72 | Washer, ⅜" Fender |
| 73 | Light Bracket Assembly |
| 73 A | Hydraulic Enclosure Cover |
| 73 B | Rubber Grommet |
| 73 C | Thumb Screw, 10–24 × ½" |
| 75 A | Angle Bracket RH (Passenger Side) |
| 75 B | Angle Bracket LH (Driver Side) |
| 80 | Control Harness Mounting Bracket |
| 85 | Hairpin Cotter, #16 |
| 86 | Clevis Pin, ⅝" × 3½" |
| 96 | Hex Head Cap Screw, ⅝"–11 × 5½" GR5 ZN |
| 97 | Nut, Self-Locking ⅝" - 11 ZN |
| 101 | Power Ground Cable Mounting Bracket |
| 102 | Rubber Split Grommet, 1⅛" |
| 104 | Weather Cap for Light & Control Harness (Vehicle Side) |
| 106 | Weather Cap for Light & Control Harness (Plow Side) |
| 108 | Headlight Adapter Kit |

Figure 2:
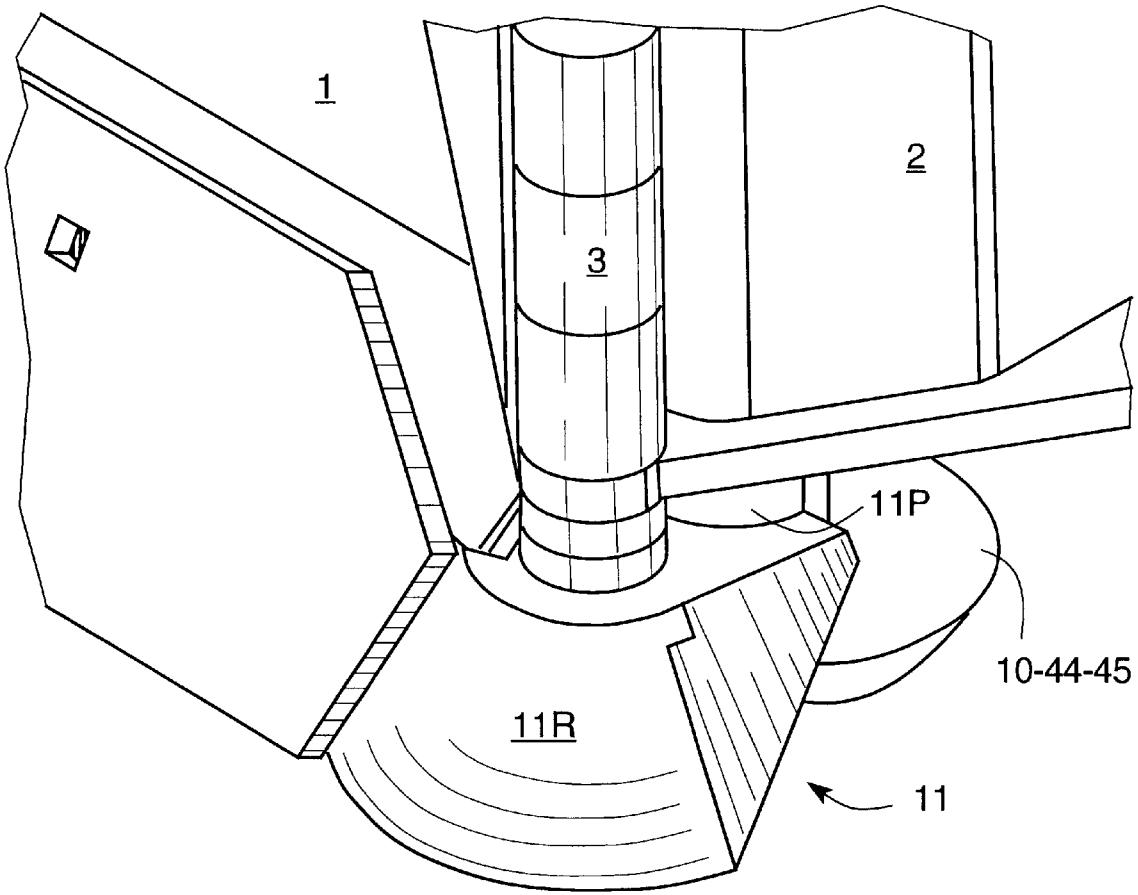
FIG. 2 is an enlarged isometric view of the snow catcher of this invention.
Figure 3:
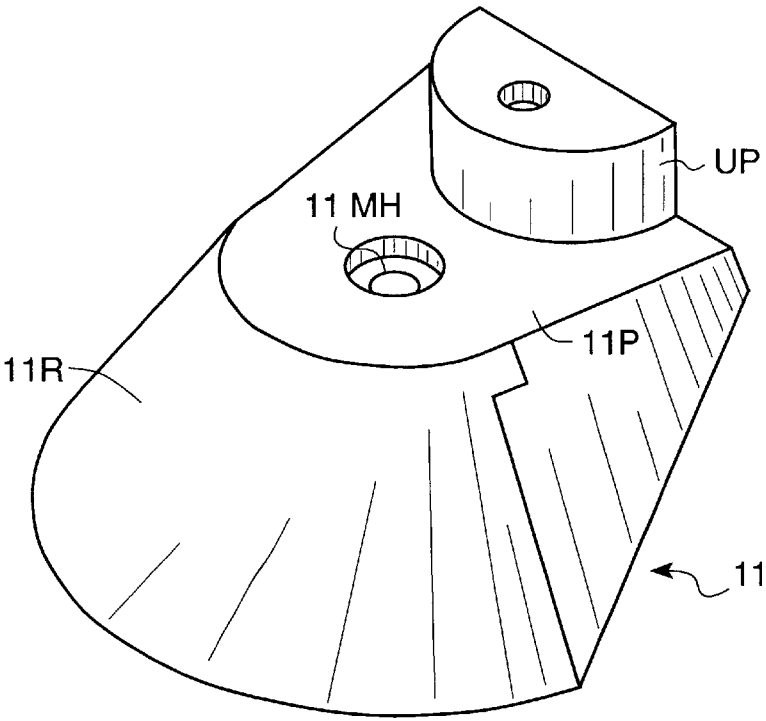
FIG. 3 is an enlarged view of the snow catcher per se.
Figure 4:
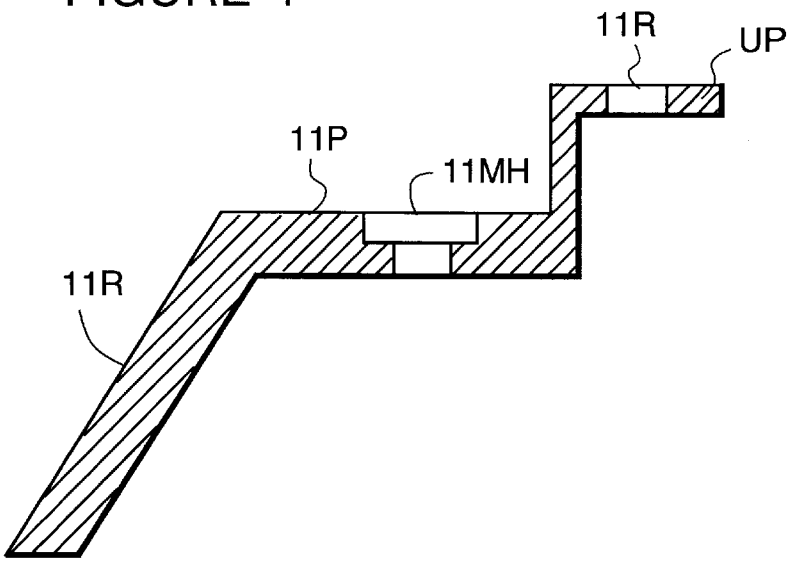
FIG. 4 is a sectional view of the snow catcher.

As shown in FIG. 1, the blades 1 and 2 of the plow are pivotally mounted on a center section 3 having a center hinge pin 13 and the angle of the blades 1 and 2 is adjusted by hydraulic cylinders 17. The invention features a plowed material catcher 11 which is fixedly mounted on the lower end of center section 3 and hinge pin 13. Plowed material catcher 11 has a ramped surface 11R which is arcuate and generally conically shaped and, in a preferred embodiment, makes an angle of about 120°–130° to the plowed surface—123.7° in the preferred embodiment. As shown in FIG. 2, the conically shaped ramp surface 11R is located behind the bottom edge of the adjustable blades 1 (The other adjustable blade 2 is removed for clarity in FIG. 2.) and closes the opening in the middle of the two blades in all positions of blade adjustment. Plowed material catcher 11 may be molded or machined from rubber, plastic or steel. The catcher 11 has a flat upper surface 11F and mounting hole 11MH. Raised portion 11P includes a key hole 11K for receiving a key pin (not shown) which prevents rotation of catcher 11.

In operation, any plowed or unplowed material which would tend to trail between the blades is blocked and directed to the plowed material catcher 11 to one blade or the other so as to not leave a trail of plowed material between the plow blades 1 and 2.

While the invention has been described in relation to preferred embodiments of the invention, it will be appreciated that other embodiments, adaptations and modifications of the invention will be apparent to those skilled in the art.

What is claimed is:

1. In a V-blade plow having a pair of adjustable plow blades having inner ends hinged on a central pivot assembly and having bottom edges, the improvement comprising a plowed material catcher member mounted below said central pivot assembly said catcher member having a conically shaped ramp surface and positioned behind said bottom edges to prevent a trail of plowed material from passing through any space between the inner ends of said blades at any position of blade adjustment.

2. The invention defined in claim 1 wherein said conically shaped ramp surface portion makes an angle of about 120°–130° to a surface being plowed.

* * * * *